US005584091A

United States Patent [19]

Borofsky

[11] Patent Number: 5,584,091

[45] Date of Patent: Dec. 17, 1996

[54] CLEANING SYSTEM WITH A CLEANING APPARATUS AND WRINGER APPARATUS

[76] Inventor: Gary R. Borofsky, 1224 Dixon La., Rydal, Pa. 19046

[21] Appl. No.: 401,735

[22] Filed: Mar. 9, 1995

[51] Int. Cl.[6] ..... A47L 13/146

[52] U.S. Cl. ..... 15/115; 15/261

[58] Field of Search ..... 15/114, 115, 247, 15/261, 116.1

[56] References Cited

U.S. PATENT DOCUMENTS

| | | | |
|---|---|---|---|
| 1,729,311 | 9/1929 | Saunders | 15/115 |
| 2,038,109 | 4/1936 | Hoffman | 15/115 |
| 3,906,580 | 9/1975 | Smith et al. | 15/115 |
| 4,414,700 | 11/1983 | Burns . | |
| 4,580,307 | 4/1986 | Moss | 15/261 |
| 4,998,314 | 3/1991 | Borofsky . | |

FOREIGN PATENT DOCUMENTS

| | | | |
|---|---|---|---|
| 788303 | 10/1935 | France | 15/115 |
| 3802198 | 6/1989 | Germany | 15/114 |
| 9194 | 4/1914 | United Kingdom | 15/115 |

OTHER PUBLICATIONS

Rubbermaid Catalog (1994–95); pp. 18–21, 28, 29, 53 and 54.

Tuway American Group Advertisement (one page).

*Primary Examiner*—Timothy F. Simone

*Assistant Examiner*—Terrence R. Till

*Attorney, Agent, or Firm*—Panitch Schwarze Jacobs & Nadel, P.C.

[57] ABSTRACT

A cleaning system includes a cleaning apparatus and a wringer apparatus. The cleaning apparatus includes a handle and a base member. The base member has a first side and a second side, with the handle being coupled to the first side of the base member. A brush portion is permanently affixed to the second side of the base member, and absorbent material is attached to the second side of the base member. A cleaning surface is formed on the second side of the base member by a combination of the brush member and the absorbent material. The wringer apparatus includes a basket for receiving the base member, the brush portion and the absorbent material. The basket has a panel, and an opening is defined in the panel for receiving the brush portion of the cleaning apparatus. The base member is positionable in the wringer basket with the brush portion inserted in the opening in the panel. The wringer apparatus also includes a press for engaging at least a portion of the absorbent material to remove moisture. The brush portion is positioned in the panel opening and remains uncompressed during moisture removal.

9 Claims, 5 Drawing Sheets

FIG. 1
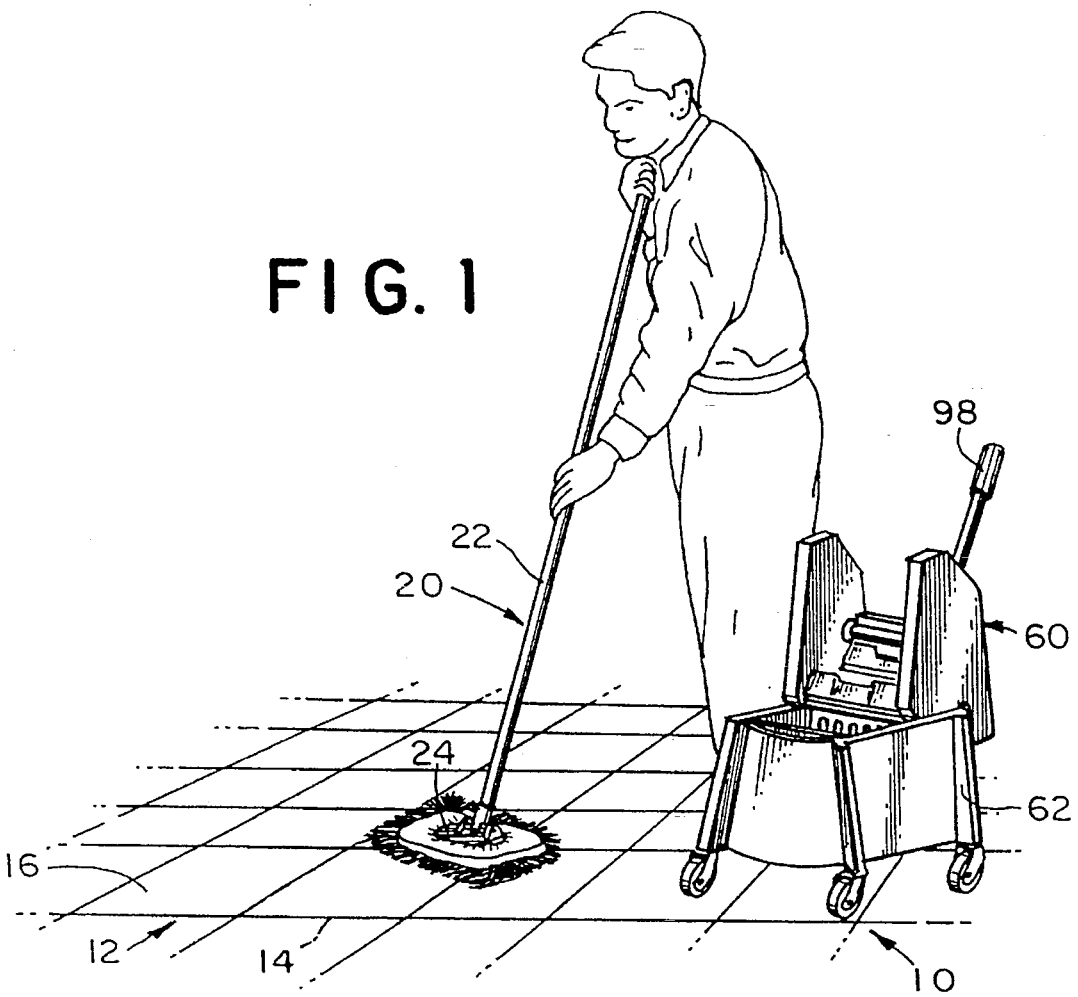
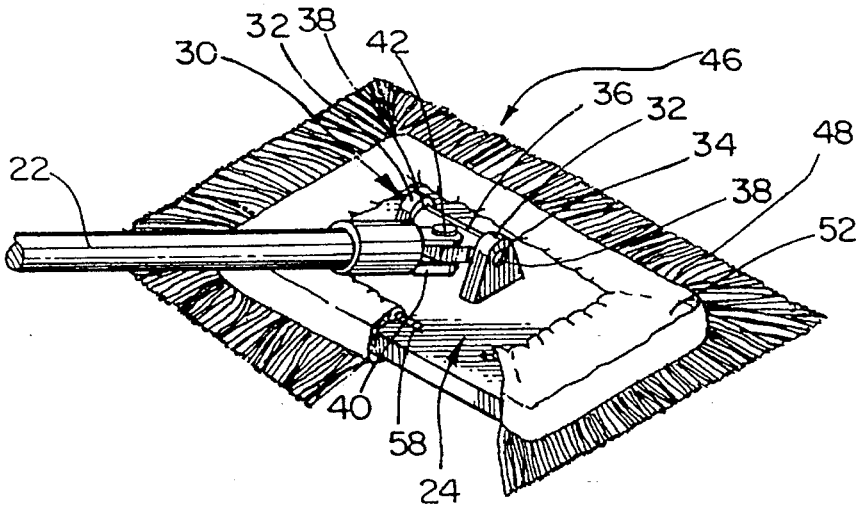
FIG. 2

CLEANING SYSTEM WITH A CLEANING APPARATUS AND WRINGER APPARATUS

FIELD OF THE INVENTION

The present invention relates to a cleaning system for floor cleaning. More particularly, the present invention provides a cleaning apparatus, having a base member with a cleaning surface formed by a combination of a brush portion and absorbent material, and a wringer apparatus configured for removing moisture from the absorbent material without damaging the brush portion.

BACKGROUND OF THE INVENTION

The maintenance of floors, and especially tile floors, typically involves cleaning with a wet mop to remove accumulated dirt. Mops typically are made of a relatively soft material, such as cotton, rayon or other synthetic material blends, which can absorb several times their weight in water. These materials are generally formed into open-twist yarns which are used to form a mop. The yarn ends can be cut or looped depending on the particular application. The mops are generally attached to a handle to allow the user to move the mop across the tile floor in an efficient manner.

Wet mops are typically used in combination with a mop bucket, for holding a cleaning fluid, and a wringer, for removing moisture from the mop to clean a floor. In use, the cleaning fluid, typically including a liquid detergent and water, is placed in the mop bucket. The mop is dipped into the bucket to absorb the cleaning fluid, then withdrawn and moved across the floor to spread the cleaning fluid on the floor. The cleaning fluid loosens or dissolves dirt from the floor surface. The mop is reinserted in the mop bucket and rinsed, then inserted in the wringer and wrung out to remove excess moisture. The damp mop is then moved across the floor area to absorb the cleaning fluid along with the dissolved dirt from the floor surface. The mop is then placed in the wringer to remove the moisture from the mop. The process is repeated until the entire floor surface is cleaned.

Grouted tile floors are generally cleaned using the mopping process outlined above. Mopping in this manner has proven to be relatively effective for cleaning the hard, relatively smooth surfaces of tiles. However, because the mop is formed from a soft, absorbent material, it does not effectively clean the grout lines between the tiles. This problem is also prevalent in flooring which has a coarse or textured surface. Typically, when grouted tile floors or flooring having a coarse or textured surface are maintained by mopping, dirt builds up in the grout lines or the textured surface and must be periodically removed by scrubbing with a brush. Because the floor is only periodically scrubbed, the process of removing the built up dirt from the grout lines and/or textured surfaces is labor intensive.

One solution to this problem is to prevent the dirt from building up in the grout lines or the textured surfaces by cleaning the grout lines and/or the textured surfaces on a more regular or even a daily basis with a scrub brush. However, this requires the maintenance worker to clean the floor first with a scrub brush and then mop the entire floor to clean the tile surface. Because this takes additional time, maintenance workers would be required to put in longer hours, or additional maintenance workers would be needed to clean the same floor area. Alternatively, the grout lines in tile floors are not given any additional cleaning and the dirt in the grout lines is allowed to build up. This is also the case for textured floors.

Accordingly, a need has arisen for providing a cleaning system for simultaneously cleaning both smooth and textured surfaces, such as in a tile floor or textured flooring, which does not require substantial additional time or maintenance personnel for cleaning the same floor area.

The present invention overcomes many disadvantages in the known cleaning systems for tile flooring by providing a cleaning system with a cleaning apparatus, having a base member with a cleaning surface formed by a combination of a brush member and absorbent material, and a wringer apparatus configured for removing moisture from the absorbent material without compressing or damaging the brush portion. This allows for brush cleaning the grout lines and/or textured surfaces during normal mopping.

SUMMARY OF THE INVENTION

Briefly stated, the present invention is a cleaning system comprising a cleaning apparatus and a wringer apparatus. The cleaning apparatus includes a handle and a base member. The base member has a first side and a second side, with the handle being coupled to the first side of the base member. A brush portion is located on to the second side of the base member, and absorbent material is attached to the second side of the base member. A cleaning surface is formed on the second side of the base member by a combination of the brush portion and the absorbent material.

The wringer apparatus includes a basket for receiving the base member, the brush portion and the absorbent material. The basket has a panel, and an opening is defined in the panel for receiving the brush portion of the cleaning apparatus. The base member is positionable in the wringer basket with the brush portion inserted in the opening in the panel. The wringer apparatus also includes a press for engaging at least a portion of the absorbent material to remove moisture therefrom. The brush portion is positioned in the panel opening and remains uncompressed during moisture removal.

BRIEF DESCRIPTION OF THE DRAWINGS

The foregoing summary, as well as the following detailed description of preferred embodiment of the invention, will be better understood when read in conjunction with the appended drawings. For the purpose of illustrating the invention, there is shown in the drawing an embodiment which is presently preferred. It should be understood, however, that the invention is not limited to the precise arrangements and instrumentalities shown. In the drawings:

FIG. 1 is a perspective view of a cleaning system in accordance with a preferred embodiment of the present invention;

FIG. 2 is an enlarged perspective view of a portion of a preferred embodiment of a cleaning apparatus in accordance with the cleaning system shown in FIG. 1;

DETAILED DESCRIPTION OF PREFERRED EMBODIMENT

Figure 3:
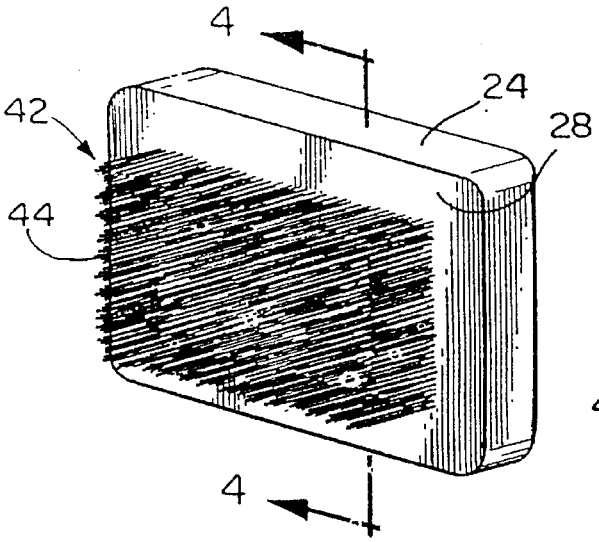
FIG. 3 is a bottom plan view of a partially assembled portion of the cleaning apparatus of FIG. 2.
Figure 4:
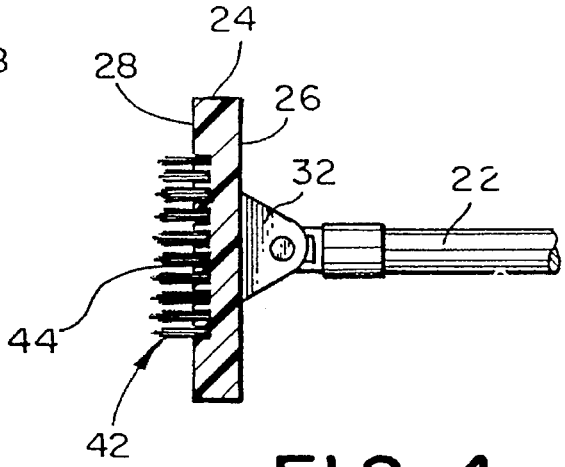
FIG. 4 is a cross-sectional view of the partially assembled cleaning apparatus shown in FIG. 3, taken along line 4—4 in FIG. 3.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the cleaning system and designated parts thereof. The terminology includes the words above specifically mentioned, derivatives thereof and words of similar import.

Referring to the drawings in detail, wherein like numerals indicate like elements throughout, there is shown in FIGS. 1—11*b* a preferred embodiment of a cleaning system, generally designated 10, in accordance with the present invention. In the preferred embodiment, shown in FIG. 1, the cleaning system 10 is used for cleaning the surface of a floor, particularly a tile floor 12 and the grout lines 14 between the individual floor tiles 16. However, it is understood by those skilled in the art from this disclosure that the cleaning system 10 is suitable for other uses, such as cleaning other types of floors, particularly floors having an irregular, coarse or textured surface, or to provide additional cleaning action for cleaning other types of floors, particularly relatively smooth flooring.

Referring now to FIGS. 1–6, the cleaning system 10 includes a cleaning apparatus 20. The cleaning apparatus 20 has a handle 22 which is attached to a base member 24. The handle 22 is preferably made of wood and is approximately one inch in diameter and sixty inches long. However, it is understood by those skilled in the art from this disclosure that the handle cross-section can vary, such as an oval or a hexagon. Additionally, the handle 22 can be made of other materials, such as steel, aluminum or fiberglass, and the length and diameter of the handle may be varied to suit particular users needs.

Referring to FIGS. 1–4, the base member 24 has a first side 26 and a second side 28. The handle 22 is removably coupled to the first side 26 of the base member 24. Preferably, the handle 22 is pivotally coupled to the first side 26 of the base member 24 with a pivotal connection 30, as shown in FIG. 2. The pivotal connection 30 is formed from uprights 32, affixed to the first side 26 of the base member 24, having aligned apertures 34 extending therethrough. A pivoting member 36, having cylindrical ends 38, is installed between the uprights 32 with the cylindrical ends 38 being pivotally positioned in the apertures 34. A clevis 40 is attached to the end of the handle 22. A pin 41 is installed through aligned apertures in the clevis 40 and the pivoting member 36.

Preferably, the base member 24 is rectangular in form, and is approximately fifteen (15) inches long and five (5) inches wide. In the preferred embodiment, the base member 24 is molded from a polymeric material and the uprights 34 are integrally formed with the base member 24. Preferably, the base member 24 is formed with an array of apertures on the second side 28. The pivoting member 36 and the clevis 40 are also made from a polymeric material. However, it is understood by those skilled in the art from the present disclosure that the base member can be oval or circular, and can be made from a variety of materials such as wood, aluminum or the like. Moreover, the invention is not limited to the preferred pivotal connection described above. Other pivotal connectors such as a ball and socket, or the like may be used. Additionally, it is similarly understood by those skilled in the art from this disclosure that the pivotal connection may be limited to motion in a single plane.

Referring to FIGS. 3–6, a brush portion 42 is affixed to the second side 28 of the base member 24. The brush portion 42 includes bristles 44 having first and second ends. The first bristle ends are secured to the base member 24. The bristles 44 are installed in the apertures on the second side 28 of the base member 24 to form the brush portion 42. The second ends of the bristles 44 have varied lengths to form an uneven scrubbing surface. Preferably, the bristles are made from NYLON. However, it is understood by those skilled in the art from the present disclosure that the bristles 44 may be made of other natural or synthetic materials, such as stainless steel or other polymeric materials having sufficient structural integrity or consistency to provide aggressive cleaning action without departing from the spirit and scope of the invention. Additionally, the length, diameter, and pattern density of the bristles 44 may be varied, as desired, to suit particular applications to form a softer or more aggressive scrubbing surface on the brush portion 42

In the preferred embodiment, a single brush portion 42 is generally centrally located on the base member 24. The brush portion 42 as shown is generally rectangular in form, but could be an elongated oval. However, it is understood by those skilled in the art from the present disclosure that more than one brush portion 42 can be used on the base member 24 without departing from the spirit and scope of the invention. For example, two discrete brush portions could be formed on the second side 28 of the base member 24. Additionally, the size and/or shape of the brush portion 42 can be varied to provide, for example, a circular or oval brush portion without departing from the scope and spirit of the present invention. Finally, it is similarly recognized by those skilled in the art from the present disclosure that the brush portion 42 may be permanently affixed to the base member 24, or a removable brush portion (not shown) may be removably attached to the base member 24 with clips, fasteners or the like.

Figure 5:
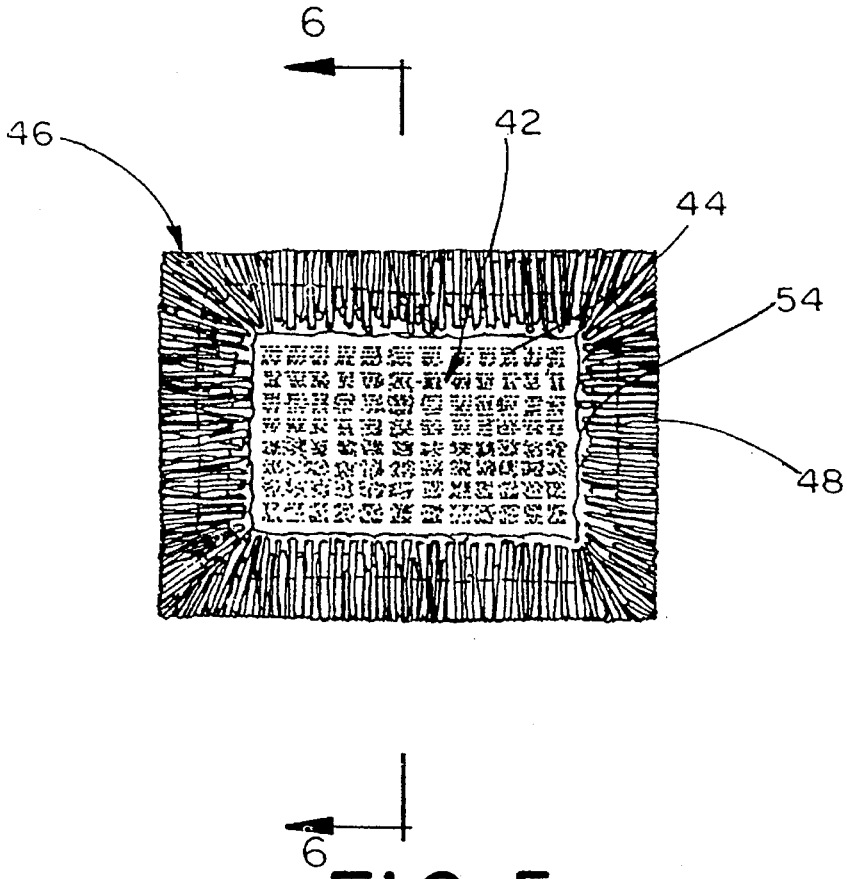
FIG. 5 is a bottom plan view of the cleaning apparatus shown in FIG. 2.
Figure 6:
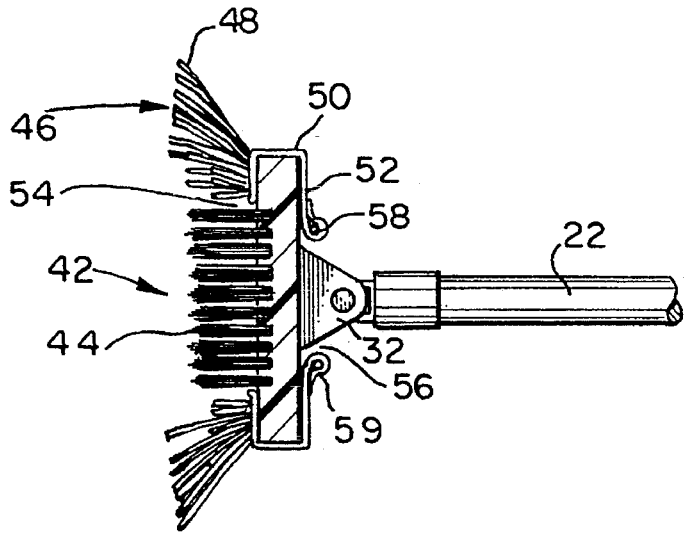
FIG. 6 is a cross-sectional view of the cleaning apparatus shown in FIG. 2, taken along line 6—6 in FIG. 5.

Referring to FIGS. 2, 5 and 6, absorbent material 46 is attached to the second side 28 of the base member 24. Preferably, the absorbent material 46 is comprised of a bed of flexible strands 48 secured to a flexible backing 50. In the presently preferred embodiment, the flexible strands 48 are yarns made from polyester, cotton and rayon or a blend thereof. However, it is understood by those skilled in the art from the present disclosure, that the flexible strands 48 could also be made of cotton or rayon or a blend of fibers to suit particular applications.

As shown in FIGS. 2 and 6, it is preferred that the flexible backing 50 forms a mophead 52 which can be installed over the base member 24. The mophead 52 acts as securing means to releasably secure the absorbent material 46 to the base member 24. The mophead 52 includes a first opening 54 defined therethrough, with the opening 54 being sized and positioned to receive the brush portion 42 such that the brush portion 42 extends through the opening 54. A second opening 56 is provided on the back of the mophead 52 to facilitate installation of the mophead 52 on the base member 24. A tie string or elastic loop 58 is installed in a pocket 59 around the periphery of the second opening 56 to secure the mophead 52 in place on the base member 24. The absorbent material 46 is removably attached to the base member 24 in this manner and a cleaning surface is formed on the second side 28 of the base member by a combination of the brush portion 42 and the absorbent material 46.

In the preferred embodiment, the flexible backing 50 is a strong fabric such as burlap or a burlap-like synthetic fabric. The flexible backing 50 must be a tightly constructed material to retain the flexible strands 48. However, it is understood by those skilled in the art from the present disclosure that the flexible backing 50 may be constructed of any material which retains the flexible strands 48, such as a molded polymeric sheet.

Alternatively, the absorbent material 46 may be comprised of the flexible strands 48, which are secured together by separate stitching (not shown) or a clamp at one end (not shown). The flexible strands 48 can then be attached to the base member 24 by conventional clips or fasteners (not shown). It is understood by those skilled in the art from the present disclosure that the absorbent material 46 can be attached to the base member 24 by any of several different methods, and the attachment method can vary, if desired, to suit particular applications without departing from the spirit and scope of the present invention.

Referring now to FIGS. 5 and 6, the flexible strands 48 are preferably positioned such that the flexible strands 48 do not substantially contact the second, exposed ends of the bristles 44. The strands 48 that are closest to the brush portion 42 have a length which is short enough to prevent the strands from substantially overlapping the brush portion 42 and becoming enmeshed in the bristles 44. The flexible strands 48 which are located further from the brush portion 42 have an increased length in proportion to the distance they are located away from the brush portion 42. However, it will be understood by those skilled in the art from the present disclosure that other means may be used to prevent the flexible strands 48 from becoming entangled in the bristles 44. For example, the bristles can be spaced sufficiently close together that the flexible strands 48 cannot become enmeshed, or the flexible strands 48 can be sewn together or banded in such a manner that the flexible strands 48 are directed away from the base member 24 and the brush portion 42. Moreover, the flexible strands 48 need not be located around the entire periphery of the brush portion 42. Those skilled in the art will understand from the present disclosure that the flexible strands 48 may be located only along one side of the brush portion 42, and be banded to extend generally in a single direction, if desired.

Referring now to FIGS. 1 and 7–11*b*, a wringer apparatus 60 (hereinafter the "wringer") of the cleaning system 10 is shown in detail.

Figure 7:
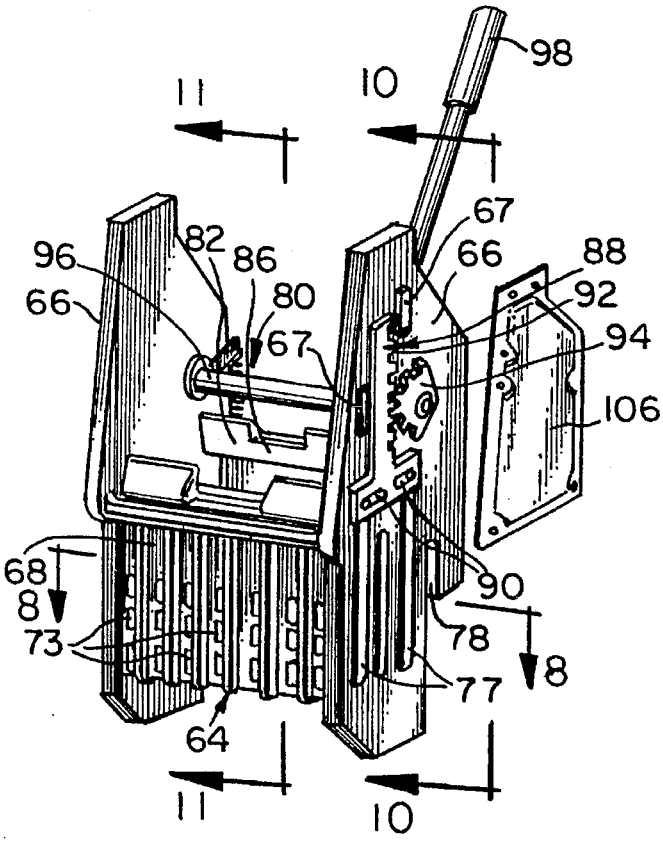
FIG. 7 is a perspective view of a preferred embodiment of a wringer apparatus in accordance with the cleaning system shown in FIG. 1.
Figure 8:
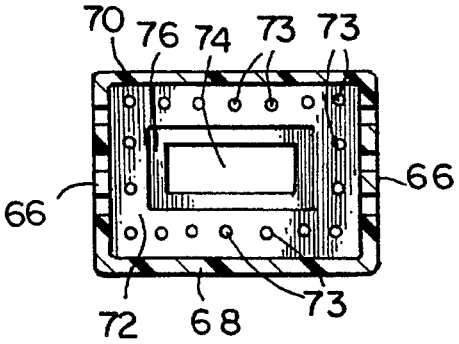
FIG. 8 is a cross-sectional view of the wringer apparatus taken along line 8—8 in FIG. 7.

As shown in FIGS. 7 and 8, the wringer 60 includes a basket 64 for receiving the base member 24, the brush portion 42 and the absorbent material 46 of the cleaning apparatus 20. The basket 64 has two side panels 66, a front panel 68, a back panel 70 and a bottom panel 72. The front 68, back 70 and bottom 72 panels have drainage apertures 73 defined therethrough.

As shown in FIG. 8, an opening 74 is defined in the bottom panel 72 for receiving the brush portion 42 of the cleaning apparatus 20. The opening 74 is generally rectangular in form and is slightly larger than the brush portion 42. The opening 74 has a depth which is greater than the length of the bristles 44. The base member 24 of the cleaning apparatus 20 is positionable in the wringer basket 64 with the brush portion 42 inserted in the opening 74 in the panel 70 with the second end of the bristles extending through the opening 74. Preferably, a recessed shoulder 76 is formed in the bottom panel 72 around the periphery of the opening 74. The recessed shoulder 76 is sized to receive the base member 24.

As shown in FIGS. 7 and 9–11*b*, each side panel 66 includes two L-shaped slots 77 in the area of the basket 64. The L-shaped slots 77 are in the opposing side panels 66 are aligned. Guide members 67 are located on the outside of each side panel 66. The side panels 66 extend above the top of the basket 64 and beyond the back panel 70. Generally vertical, aligned notches 78 are defined in each side panel 66 outside of the basket 64, spaced outward from the back panel 70. Preferably, the basket 64, including the side panels 66, the front panel 68, the back panel 70 and the bottom panel 72, is molded from as a single piece from a polymeric material. However, it is understood by those skilled in the art from the present disclosure that the basket 64 may be made of other suitable material such as aluminum or metal. Moreover, the basket 64 can be assembled from separate pieces and need not be formed as a unitary structure. Additionally, the size of time basket may vary to suit particular applications. Finally, the opening 74 in the bottom panel 72 may vary in size and shape depending on the particular configuration of the brush portion being used.

Referring to FIGS. 7 and 9–11*b*, a press 80 is located above the basket 64. The press 80, which is most clearly shown in FIG. 9 where the basket 64 is shown in phantom, includes two press members 82, each having a relatively flat press portion 86, movably installed over the basket 64 between the side panels 66. A notch 85 is formed at a medial location in each press member 82. The end of each press member 82 includes a follower member 83 which is generally normal to the press portion 8 of the press members 82. The follower members 83 are slidably disposed in the aligned L-shaped slots 77 in the opposing side panels 66. A drive pin 84 is located on the end of each follower member 83. Preferably the press members 82 are molded from a polymeric material as a single piece. However, it is understood by those skilled in the art from the present disclosure that the press members 82 may be made from various materials, such as aluminum, and that the configuration of the press members 82 can vary to suit particular basket configurations.

Figure 9:
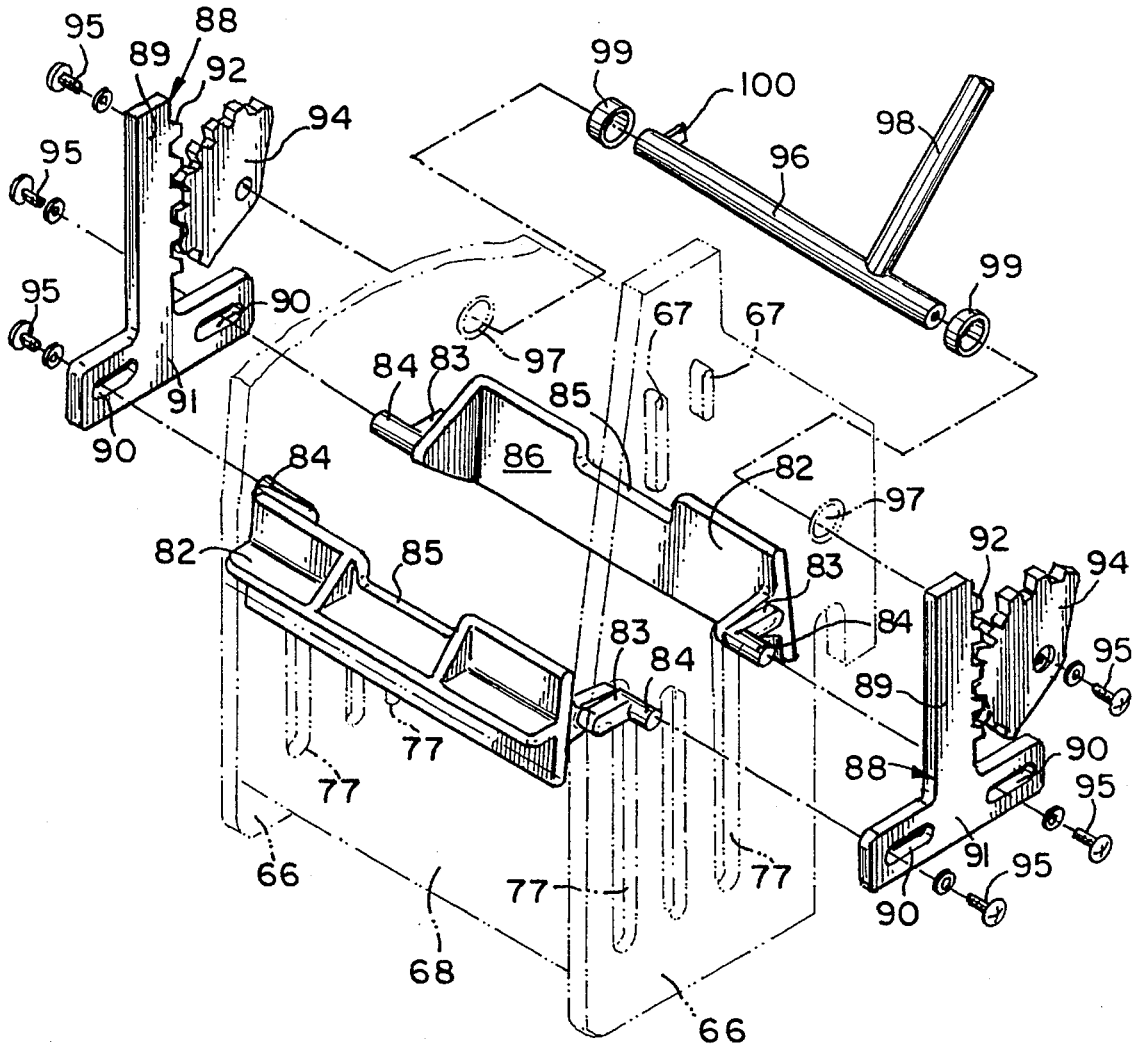
FIG. 9 is an enlarged perspective view, partially in phantom, partially broken away, and partially exploded, of the wringer apparatus shown in FIG. 7.
Figure 10:
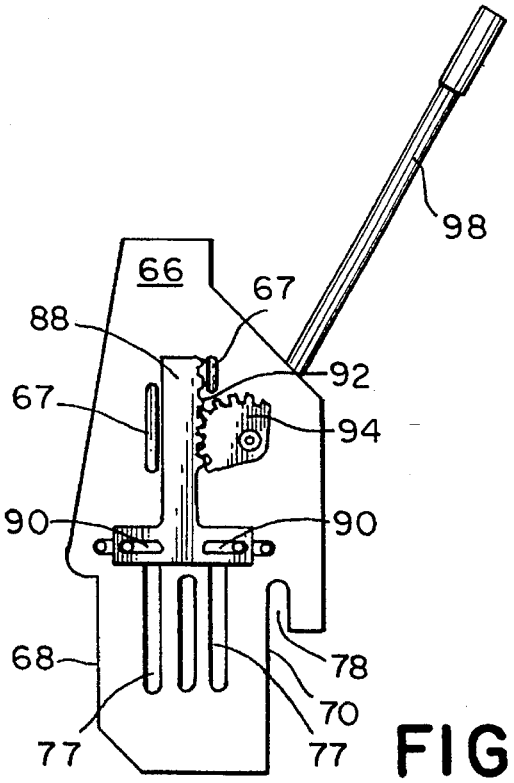
FIG. 10 is a side elevation view of the wringer apparatus shown in FIG. 7 taken along line 10—10 in FIG. 7.

Referring to FIGS. 7, 9 and 10, a drive rack 88 is positioned between the guide members 67 on the outside of each side panel 66 of the wringer 60. Each drive rack 88 is T-shaped, having an upright portion 89 and a cross portion 91. Gear teeth 92 are formed on one side of the upright portion 89, and two slots 90 are located in the cross portion 91 of the drive rack 88. The upright portion 89 is installed between the guides 67 on the side panels 66. The drive pins 84 on each press member 82 extend into a slot 90 in each drive rack 88. Fasteners 95 are installed into the ends of the drive pins 84 to maintain the drive pins 84 in position in the slots 90. The fasteners 95 are preferably screws with washers, but those skilled in the art will recognize from this disclosure that other fasteners 95 such as rivets, clips or the like may be used.

Referring to FIGS. 7 and 9, a shaft 96 having a handle 98 is installed between the two side panels 66. The ends of the shaft 96 are inserted in aligned apertures 97 in the side panels 66. Bushings 99 are pressed into position between the apertures 97 and the shaft 96. Gear segments 94 are attached to each end of the shaft 9.6 with fasteners 95. The gear segments 94 mesh with the teeth 92 on the drive racks 88.

A lever 100 is also attached to the shaft 96 in a position between the two side panels 66. A spring 102 is installed between the lever 100 and an aperture 104 in one side panel 66 to bias the shaft 96 and the handle 98 to a first position.

In the preferred embodiment, the drive racks 88 and the gear segments 94 are molded from a polymeric material. The gear teeth 92 and the gear segment 94 have a pitch of approximately 2, and the radius of gear segment 94 is approximately 2¼ inches. However, it is understood by those skilled in the art from this disclosure that the drive racks 88 and gear segments 94 may be made of other materials, such as steel or other metals. Moreover, the size of the gear segment 94 and the pitch can be varied to suit particular applications. The bushings 99 are preferably made of a polymeric material. However, those skilled in the art will recognize from the present disclosure that the bushings 99 can be made of various materials, such as bronze, steel or a sintered, self lubricated composite. Additionally, the size of the bushings 99 can vary in accordance with the size of the shaft 96. Preferably, the shaft 96 and the handle 98 are made from 1.0 inch diameter steel tubing, and the lever 100 is made from steel plate. The shaft 96, the handle 98 and the lever 100 are preferably welded together as a unitary assembly. Preferably, the shaft 96, the handle 98 and the lever 100 are galvanized to resist corrosion. However, it is understood by those skilled in the art that the shaft 96, the handle 98, and the lever 100 can be made of other materials having sufficient strength, such as plastic, aluminum or a reinforced composite material. Moreover, the size of the handle 98 and the shaft 96 can be varied to suit particular applications. For example, the handle length can be increased to create a greater pressing force.

As shown in FIG. 7, removable covers 106 are preferably attached to the side panels 6 to cover the drive racks 88 and the gear segments 94. Preferably, the covers 106 are made of a polymeric material and are attached to the side panels with screws. However, it is understood by those skilled in the art from the present disclosure that the covers 106 may be made from other suitable materials, such as sheet metal. Additionally, the covers 106 may be attached by an interference fit, clips or other suitable fasteners.

As described above, the preferred wringer 60 is a down press wringer 60. However, it is understood by those skilled in the art from the present disclosure that the type of wringer 60 can be varied, depending on the particular application. For example, the wringer 60 may be a sideward press wringer (not shown).

Having described the structure of the cleaning system 10 in detail, a brief description of its operation follows with reference to FIGS. 1, 7–9, 11*a* and 11*b*. The wringer 60 is installed on a bucket 62 by placing the notches 78 over a side of the bucket 62. A cleaning fluid (not shown), generally comprised of a detergent and water, is placed in the bucket 62. After moving the bucket 62 with the wringer 60 to the desired location, the user grasps the handle 22 of the cleaning apparatus 20 and places the base member 24, brush portion 42 and absorbent material 46 into the bucket 62. The absorbent material 46 absorbs the cleaning fluid, and the base member 24, brush member 42 and the absorbent material 46 of the cleaning apparatus 20 are then withdrawn from the bucket 62. The user then moves the cleaning apparatus 20 back and forth across an area of the floor 12, in the same manner as a traditional mop, to spread the cleaning fluid on the floor 12. The bristles 44 on the brush portion 42 of the base member 24 scrub the grout lines 14 between the tiles 16 as the cleaning apparatus 20 is moved in this normal fashion. If desired, the cleaning apparatus 20 may be moved generally parallel to and over the grout lines 14 for enhanced cleaning of the grout lines 14 by the bristles 44.

The user then places the base member 24, brush portion 42 and absorbent material 46 of the cleaning apparatus 20 in the bucket 62 to rinse accumulated dirt and debris from the absorbent material 46. Next, the user places the base member 24, the brush portion 42 and the absorbent material 46 in the wringer basket 64 with the brush portion 42 inserted in the opening 74 in the bottom panel 72. The press handle 98 is then pulled forward from the first position, shown in FIG. 11*a*, causing the gear segments 94 to rotate. As the gear segments 94 rotate, the drive racks 88 are moved downward by the teeth 89 meshing with the gear segments 94. The drive pins 84 on each press member 82, located in slots 90, are forced to move downward, pulling the followers 83 inward and downward along the path of the L-shaped slots 77 in the side panels 66. As the followers 83 move along the L-shaped slots 77, the flat portion 86 of each press member 82 is rotated to a generally horizontal position, parallel to the bottom panel 72. As the press members 82 move downward, toward the position shown in FIG. 11*b*, they engage at least a portion of the absorbent material 46 and compress the absorbent material 46 to remove moisture therefrom. Clearance for the handle 22 is provided by the notches 85 in the press members 83, and the brush portion 42, which is positioned in the bottom panel opening 74, remains uncompressed during moisture removal.

Figure 11A:
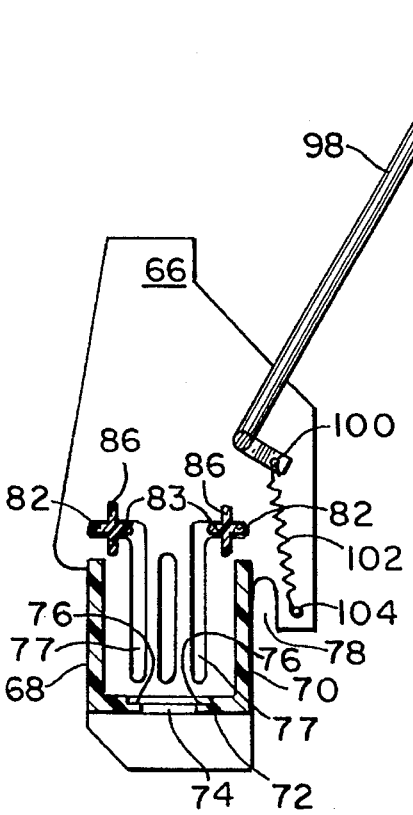
FIG. 11*a* is a cross-sectional view of the wringer apparatus shown in FIG. 7 taken along line 11—11 in FIG. 7.
Figure 11B:
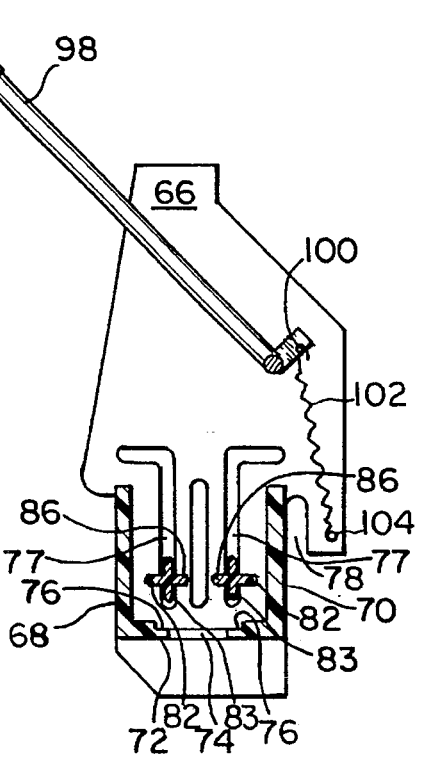
FIG. 11*b* is a cross-sectional view similar to FIG. 11*a* illustrating the wringer apparatus shown in FIG. 7 in the moisture removal position.

The user then releases the handle 98 of the wringer 60, and the press members 82 and the handle 98 are returned to the first position, shown in FIG. 11*a*, by the spring 102 acting on the lever 100. The user then removes the cleaning apparatus 20 from the wringer 60 and moves the brush portion 42 and the absorbent material 46 back and forth across the area of the floor 12 which was previously coated with the cleaning fluid to absorb the cleaning fluid and remove any loosened dirt. As the cleaning apparatus 20 is moved back and forth across the floor, the bristles 44 of the brush portion 42 again scrub the floor 12 and, in particular the grout lines 14. The cleaning fluid and any dissolved dirt is absorbed by the absorbent material 46. The base member 24, brush portion 42 and absorbent material 46 are then replaced in the wringer 60, with the brush portion 42 inserted into the opening 74 and the press 80 is used to remove moisture from the absorbent material 46 in the above-described manner. This process is repeated until the entire floor 12 is cleaned, cleaning both the tile surface 16 and the grout lines 14.

For added versatility, the wringer 60 is provided with a perforated plug (not shown) which can be snapped into the opening 74 to allow the wringer 60 to be used in conjunction with a traditional mop. Preferably, the plug is made of the same polymeric material as the basket 62 and is sized to be pressed into the recessed shoulder 76 and the opening 74. However, it is understood by those skilled in the art from the present disclosure that the plug may be made of various materials such as stainless steel, aluminum or a different polymeric material. Additionally, it is understood that the plug may be held in position by an interference fit, removable fasteners or the like.

It will be appreciated by those skilled in the art that changes could be made to the embodiment described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A cleaning system comprising:

a cleaning apparatus including:

a handle, a base member having a first side and a second side, the handle being coupled to the first side of the base member, a brush portion located on the second side of the base member, and absorbent material attached to the second side of the base member, whereby a cleaning surface is formed on the second side of the base member by a combination of the brush portion and the absorbent material; and a wringer apparatus including;

a basket for receiving the base member, the brush portion and the absorbent material, the basket having a panel;

an opening in the panel for receiving the brush portion of the cleaning apparatus, the base member being positionable in the wringer basket with the brush portion inserted in the opening in the panel; and a press for engaging at least a portion of the absorbent material to remove moisture therefrom whereby the brush portion is positioned in the panel opening and remains uncompressed during moisture removal.

2. The system of claim 1 wherein the absorbent material is removably attached to the base member.

3. The system of claim 1 wherein the absorbent material is comprised of a bed of flexible strands secured to a flexible backing.

4. The combination of claim 3 wherein the flexible backing forms a mophead, the mophead includes an opening defined therethrough, the opening being sized and positioned to receive the brush portion such that the brush portion extends through the opening.

5. The combination of claim 4 wherein the brush portion includes bristles having first and second ends, the first bristle ends being secured to the base member, the flexible strands being positioned such that the flexible strands do not substantially contact the second end of the bristles.

6. The combination of claim 1 further including securing means for releasably securing the absorbent material to the base member.

7. The combination of claim 1 wherein the handle is pivotally coupled to the first side of the base member.

8. The apparatus of claim 1 wherein a recessed shoulder is formed in the panel around the periphery of the opening, the recessed shoulder being sized to receive the base member.

9. The apparatus of claim 1 wherein the brush portion is permanently affixed to the base member.

* * * * *